United States Patent [19]

James

[11] 4,271,459

[45] Jun. 2, 1981

[54] VEHICLE HEADLAMP ASSEMBLY

[75] Inventor: Haydn James, Rugeley, England

[73] Assignee: Lucas Industries Limited, Birmingham, England

[21] Appl. No.: 4,234

[22] Filed: Jan. 17, 1979

[51] Int. Cl.[3] ..... F21V 7/00

[52] U.S. Cl. ..... 362/346; 362/83; 362/297

[58] Field of Search ..... 362/61, 80, 83, 263, 362/297, 248, 301, 346, 347

[56] References Cited

U.S. PATENT DOCUMENTS

| | | | |
|---|---|---|---|
| 1,949,503 | 3/1934 | Thorburn | 362/301 |
| 3,688,149 | 8/1972 | Pitkjaan | 362/346 |

*Primary Examiner*—Donald P. Walsh
*Attorney, Agent, or Firm*—Ladas & Parry

[57] ABSTRACT

A vehicle lamp assembly comprises a reflector having upper and lower paraboloidal portions separated by a downwardly facing step. A filament of a halogen bulb having an envelope is mounted in the reflector 10 and a filament shield consisting of two die cast plate portions are disposed on opposite sides of the filament. Upper surfaces of the portions are disposed in mutually inclined planes which intersect at the axis of filament. Inner edges of the portions are disposed as near as possible to the filament and arc as thin as possible. Outer edges of the portions are thicker than the inner edges such that they cause substantially no further obscurement of the reflector than that caused by the inner edges. The plate portions are shaped and positioned so as to prevent reflections from the envelope and from the step from emerging upwardly from the lamp assembly.

9 Claims, 12 Drawing Figures

Figure 1:
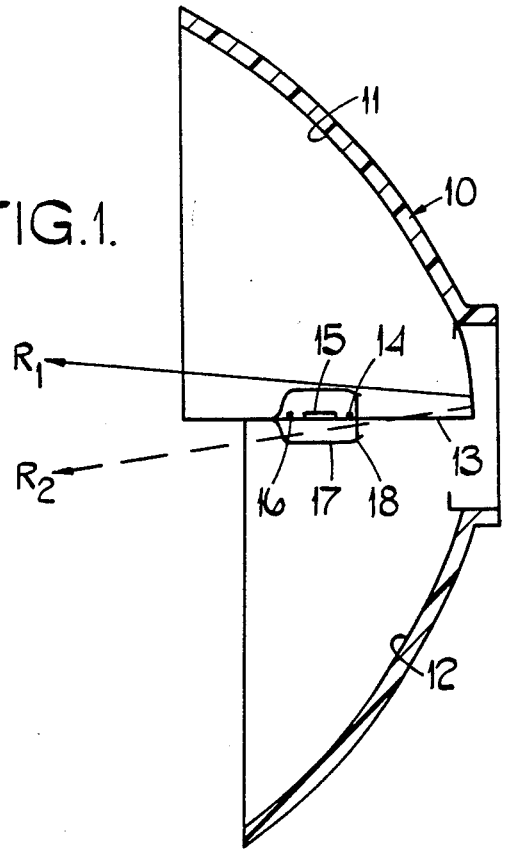

FIG.7.
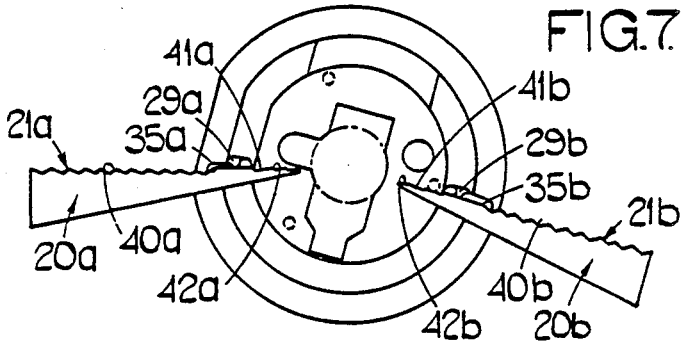
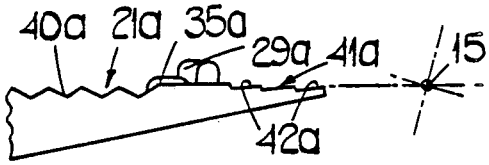
FIG.7a.
FIG.8.
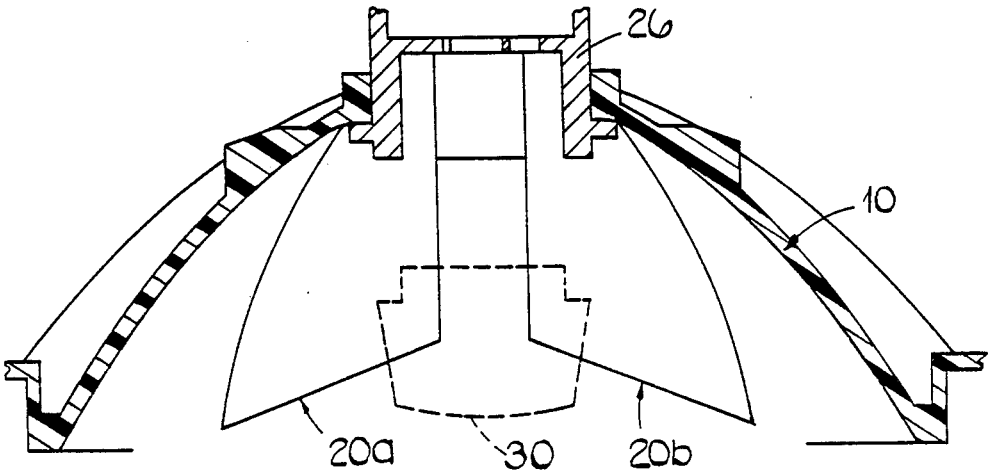

VEHICLE HEADLAMP ASSEMBLY

This invention relates to a vehicle headlamp assembly and is more particularly concerned with a vehicle headlamp assembly having a reflector in which upper and lower portions thereof do not lie on a continuous surface, i.e. there is a split line or step between the upper and lower reflective portions.

It is well known to provide a plain paraboloidal reflector in a vehicle headlamp assembly. However, in order for the assembly to be used under passing or dipped beam conditions, as opposed to main or full beam conditions, it is necessary for the lower half of the reflector to be shielded so that light emanating from a filament of a bulb mounted in the lamp assembly is prevented from being reflected off the lower part of the reflector. This provides a cut off to the top of the beam which, by suitably designing the shield, can produce the desired cut-off to the top of the beam. It will be appreciated however, that such an arrangement reduces the light output of the lamp assembly under passing or dipped beam conditions. This reduction of light output is, under most circumstances, undesirable. In an effort to obviate or mitigate this problem, it is known to provide a composite reflector consisting of upper and lower paraboloidal portions separated by a split line or step. The arrangement of the upper and lower portions of the reflector relative to the filament used under dipped or passing beam conditions is such that light emanating from the filament which is incident upon the lower portion of the reflector is reflected downwardly rather than upwardly and so augments the beam pattern below a cut-off which is defined by the split or step between the upper and lower reflector portions. The Applicants have found, however, that if such a reflector construction is used in conjunction with a halogen bulb, stray reflections are produced which increase the light intensity above the desired cut-off to the top of the beam projected by the lamp assembly. Such stray reflections increase the glare values to an unacceptable extent. The Applicants have found that there are two causes for these stray light reflections. The first cause is due to the provision of a layer of lacquer over the reflective surface. A layer of lacquer is necessary to produce the required specular surface of the reflector. However, there is a tendency for the lacquer to form a bead which extends along the split or step line. This detracts from the sharp edge necessary for a sharp cut-off. The second cause of these stray reflections is the quartz envelope used to house the filament in the halogen bulb. Whilst it is possible to avoid the stray reflections caused by the lacquer bead merely by painting the edge of the split or step line with a matt black paint, thus providing a sharper cut-off this does not totally overcome the problem of high glare levels which result from reflections within the quartz envelope of the halogen bulb.

It is therefore an object of the present invention to provide a vehicle headlamp assembly in which the problem of high glare levels resulting from reflections within the quartz envelope of the halogen bulb is obviated or mitigated without affecting, to a substantial extent, the total light output of the headlamp assembly under passing or dipped beam conditions.

According to the present invention, there is provided a vehicle headlamp assembly comprising a reflector having upper and lower reflective portions separated by a split line and a filament shield, said filament shield comprising a pair of plate portions disposed on opposite sides of a location at which a lamp filament is located in use, each plate portion being substantially aligned with the split between the upper and lower reflective portions and extending forwardly of the headlamp assembly substantially axially of the reflector.

In the ideal case, the filament shield is infinitely thin. However, as an approximation to this, the filament shield may be formed of two pieces of thin sheet material. But such a construction suffers from the disadvantage that it is not particularly robust and it requires a relatively complicated fixing arrangement to ensure that it is fixed correctly.

Thus, it is preferred for the filament shield to comprise a pair of plate portions which are relatively robust and which are preferably die cast. Therefore, these plate portions need to have a certain minimum thickness. It is important for the thickness to be kept to a minimum along an inner edge of each plate portion i.e. the edge, which is nearest to the filament in use, so as to minimise the area of the reflector which is obscured by the shield. Since the inner edge of each plate portion inevitably obscures some of the reflector from light emanating from the filament, it is possible to arrange the outer edge of each plate portion to have an increased thickness compared with the inner edge, the actual thickness of the outer edge being chosen such that there is substantially no further obscuring of the reflector from light emanating directly from the filament in use. This means that a relative robust shield can be provided.

The actual thickness of the outer edge of each plate portion will be determined by the focal length of the upper and lower reflector portions, the aperture of the reflector, the distance of the portion of the bulb envelope which causes the unwanted reflections from the filament, and the position of the bulb relative to the focal points or planes of the upper and lower reflector portions.

With the above construction, the upper surfaces of the plate portions of the filament shield are arranged to define the upper cut-off of the beam and are rendered suitably non-reflective in order to minimise unwanted reflection therefrom. In a preferred embodiment, each upper surface has grooves therein and is also provided with a matt or non-reflective finish, (e.g. a matt finish in a dark shade such as black), this finish serving to reduce reflections from the surface and the grooves tending to scatter any stray reflections. Inner edge portions of the upper surfaces are preferably provided with steps therein, thus steps having upper surfaces or "treads" which are angled relative to the filament location such that in use, they are in shadow.

It is preferred for the plate portions to be die cast integrally with a bulb holder which is mounted in a rear aperture in the reflector. Such a form of construction is relatively robust and is ideally suited to mass production techniques. Such shield masks the split line of the reflector and so reduces the above-discussed effect of stray reflection from the lacquer bead which extends along the split line.

In a preferred construction, each plate portion is constructed so as to provide a support for a shield which serves to prevent light passing directly out of the opening of the reflector without being reflected by the reflector. Such a shield is commonly referred to as an "up-light" shield since it is provided in front of the filament.

The invention also resides in a die casting comprising a bulb holder and an integral filament shield of the above defined type.

Figure 2:
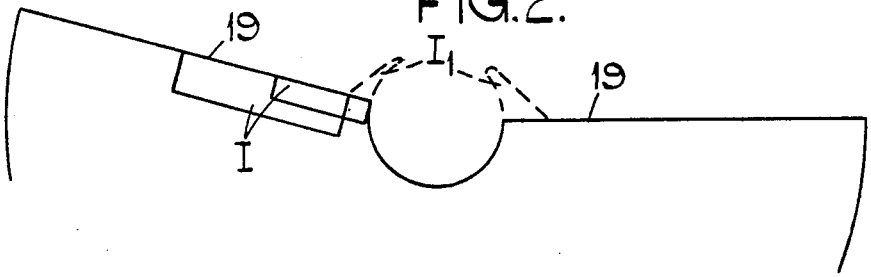
Figure 3:
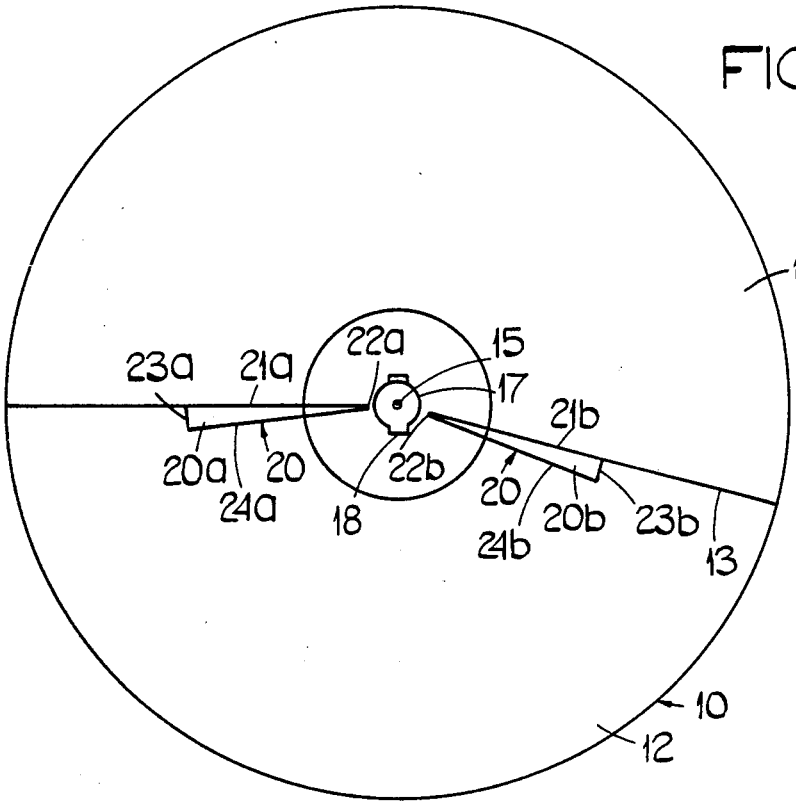
Figure 4:
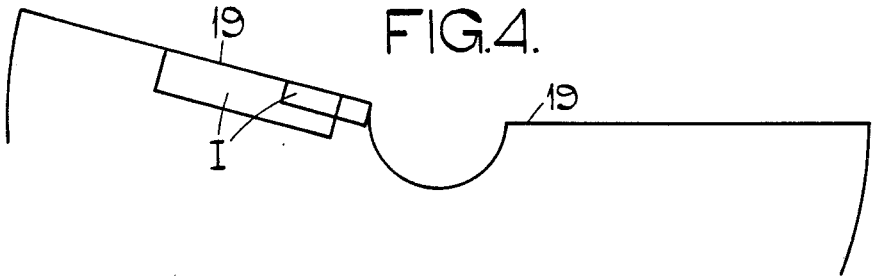
Figure 5:
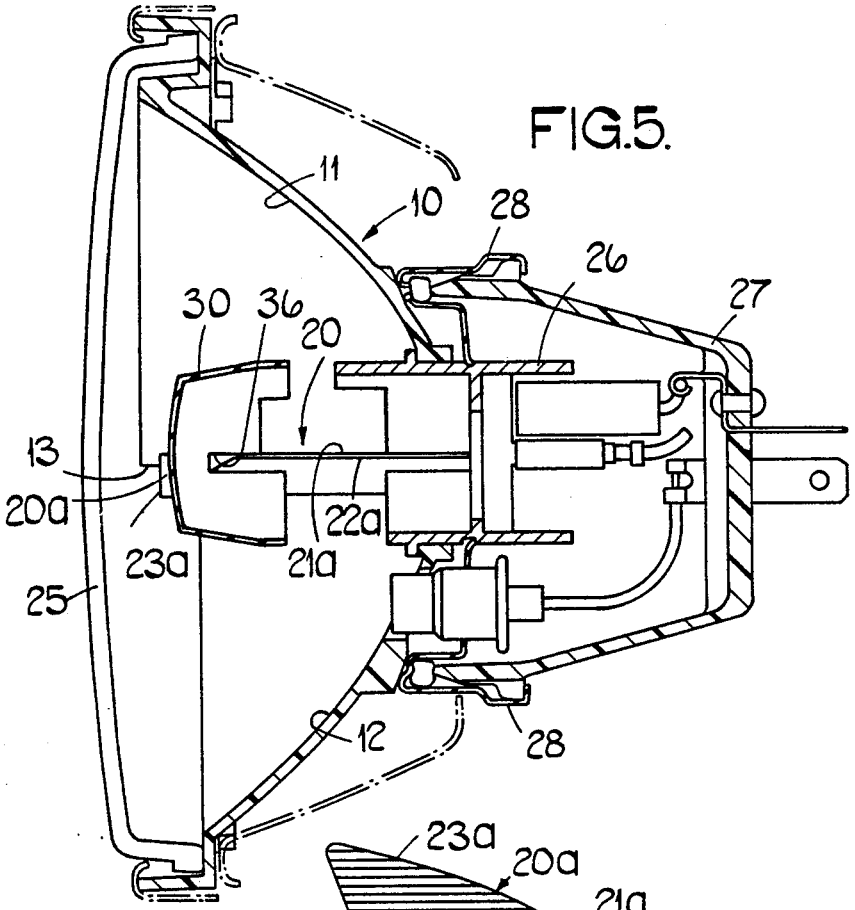
Figure 6:
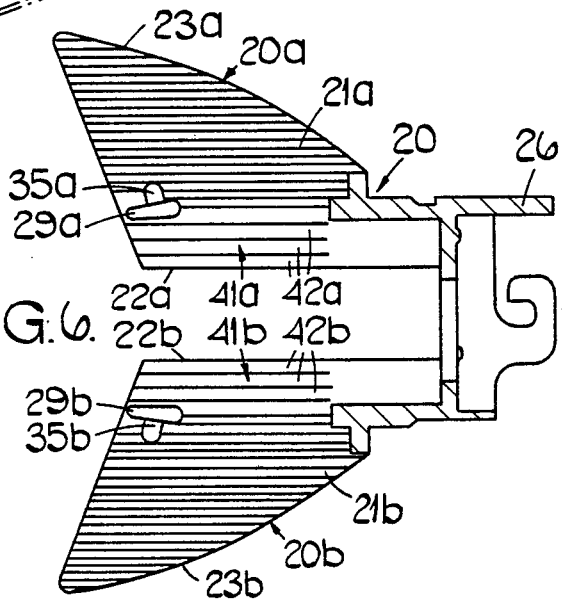

Embodiments of the present invention will now be described, by way of example, with reference to the accompanying drawings, in which:

FIG. 1 is a schematic side view of a vehicle headlamp assembly showing the effect of a stray reflection from an envelope of halogen bulb, FIG. 2 is a schematic illustration of the upper portion of a beam projected by the headlamp assembly of FIG. 1, FIG. 3 is a schematic front view of a vehicle headlamp assembly according to one embodiment of the present invention, FIG. 4 is a schematic illustration of the upper portion of a beam projected by the assembly of FIG. 3, FIG. 5 is an axial sectional view of a more practical form of vehicle headlamp assembly according to the present invention, FIG. 6 is an axial section taken at right angles to the section of FIG. 5, of a filament shield forming part of the assembly of FIG. 5, FIG. 7 is a front view of the shield illustrated in FIG. 6, FIG. 7*a* is a view on a larger scale of part of the shield of FIG. 7, FIG. 8 is an axial section of part of the lamp assembly illustrated in FIG. 5, the section being taken at right angles to that of FIG. 5, FIGS. 9, 10 and 11 illustrate the dimensions taken into account when determining the shape required of a preferred form of filament shield used in a vehicle headlamp assembly according to the present invention.

Referring now to FIG. 1 a lamp reflector 10 comprises upper and lower paraboloidal portions 11 and 12 separated by a split 13. The reflector 10 is of the type described in our British patent application No. 25310/76 with reference to FIGS. 1 to 3. Briefly, the upper paraboloidal portion 11 has a focal length which is less than that of the lower paraboloidal portion 12 and has its focal point 14 lying on the axis of the reflector 10 and behind a filament 15 of a quartz halogen bulb. The focal axis of the upper paraboloidal portion 11 lies on the axis of the reflector 10. The lower paraboloidal portion 12 has a focal length which is greater than that of the upper paraboloidal portion 11 and has its focal point 16 lying on the axis of the reflector 10 but forwardly of the filament 15. The focal axis of the lower paraboloidal portion 12 is inclined at an angle of ½° downwardly relative to the horizontal plane, i.e. the plane in which the axis of the reflector 10 lies with the reflector 10 in the orientation illustrated in FIG. 1. The split 13 is defined by a step in the reflector 10 which, on the inner surface of the reflector 10, faces downwardly. Such a construction of reflector ensures that light emanating from the filament 15 and striking either of the respective portions 11 and 12 will be deflected generally downwardly as indicated by $R_2$ so as to define a basic, i.e. unlensed, beam pattern of the type shown in full line in FIG. 2. The beam pattern is made up of a number of images I of the filament 15. However, with a halogen bulb, the filament 15 is mounted in a quartz glass envelope 17. The disadvantage of such a construction is that multiple reflections of light occur at a lower pinched portion 18 of the envelope 17. The reflections are directed upwardly onto the upper paraboloidal portion 11 at an angle such that the resultant reflected rays are directed upwardly. One such ray is indicated at $R_1$ in FIG. 1. The reflected rays $R_1$ consequent upon reflection by the envelope 17 produce images $I_1$ above a desired cut-off line 19 to the top of the beam. These images $I_1$ are undesirable since they cause unwanted glare. It is to be appreciated that the inclined nature of the upper cut-off line 19 is provided because the split 13 is inclined as will be apparent from our British patent application No. 25310/76. The beam pattern illustrated in FIG. 2 is that produced by the reflector 10 alone without any lensing.

Referring now to FIG. 3, there is shown a construction which is intended to prevent the formation of images $I_1$. In the construction of FIG. 3, the reflector 10, the filament 15 and the envelope 17 are as described with reference to FIG. 1. In the view shown in FIG. 3, the inclined nature of the split 13 can be readily seen. In order to prevent light reflected from the portion 18 of the envelope 17 from reaching the upper paraboloidal portion 11, a shield 20 is provided. This shield 20 is provided in two parts 20*a* and 20*b* which are disposed on opposite sides of the filament 15 and envelope 17. Each shield part 20*a*, 20*b* is provided with a substantially planar upper surface 21*a*, 21*b* which is, in this embodiment, aligned with the respective portion of the split 13. Thus, as can be seen from FIG. 3, the filament 15 which is located on the axis of the reflector 10, has its axis lying in a horizontal plane in which the upper surface 21*a* lies. The axis of the filament 15 also lies in a plane inclined to the horizontal in which the upper surface 21*b* lies. The inclination of the latter plane to the horizontal is about 15°. Each shield part 20*a*, 20*b* extends forwardly of the reflector 10, i.e. towards the front opening of the reflector 10 so as to define a respective inner side edge 22*a*, 22*b*, and a respective outer side edge 23*a*, 23*b*. The thickness of the outer side edge 23*a*, 23*b* is greater than the corresponding inner side edge 22*a*, 22*b* and each shield part 20*a*, 20*b* is provided with a planar lower surface 24*a*, 24*b*. Thus, each shield part 20*a*, 20*b* has a wedge-shaped section when viewed from the front of the reflector. The thickness of each inner side edge 22*a*, 22*b*, is as small as possible (about 0.5 mm being the practical minimum). The thickness of each outer side edge 23*a*, 23*b* is determined by the thickness of the inner side edge 22*a*, 22*b* so that light emanating from the centre of the filament 15 is not further masked by the lower surface 24*a*, 24*b*, it being appreciated that the light will be masked to some extent because the inner side edges 22*a* and 22*b* are of a finite thickness. The side edges 22*a* and 22*b* are located as near as possible to the filament having regard to the fact that the envelope 17 is provided around the filament 15 and to the fact that a certain amount of spacing is required from the envelope 17 in order to accommodate for tolerances in the mounting of the halogen bulb in the reflector. The factors determining the precise shape of the shield parts 20*a* and 20*b* will be discussed hereinafter. However, when the shield parts 20*a* and 20*b* are correctly dimensioned, the effect of the provision of such shield parts is to remove the images $I_1$ illustrated in FIG. 2 to produce a beam pattern of the type illustrated in FIG. 4 where there is provided a relatively sharp cut-off line 19 with substantially no images above the line.

Turning now to FIG. 5 of the drawings, the lamp assembly illustrated therein is similar to that illustrated in FIG. 4 of our co-pending British patent application No. 25310/76. In this lamp assembly, the reflector 10 as described with reference to FIG. 1 is employed. In addition to the reflector 10, the lamp assembly includes a lens element 25 closing the front of the reflector 10 and a die cast bulb holder 26 mounted in the reflector 10 in a similar manner to that described in our co-pending British patent application No. 25310/76. The lamp assembly further includes a rear casing 27 sealingly secured to the rear of the bulb holder by means of a collar 28 secured to the bulb holder 26 and having inturned projections which engage inclined surfaces on the casing 27 in the manner of a short, multistart screw threads.

The lamp assembly is further provided with the shield 20 illustrated in FIG. 3 (in FIG. 5 only the shield part 20*a* is illustrated). In this embodiment, however, the angled split 13 between the upper and lower paraboloidal portions 11 and 12 of the reflector 10 is so disposed relative to the shield 20 that it lies between the upper and lower surfaces of the respective shield parts 20*a*, and 20*b*. Thus, the angled split 13 is masked from the filament of the bulb and so the previously mentioned problem of unwanted reflections from lacquer beading on the split 13 is avoided. The shield parts 20*a* and 20*b* are die cast integrally with the bulb holder 26. Referring now particularly to FIG. 6, it will be seen that the inner side edges 22*a* and 22*b* of the shield part 20*a*, 20*b* are linear in the axial extent of the reflector and extend parallel to the axis of the reflector whilst the outer side edges 23*a* and 23*b* are convexly curved. The upper surfaces 21*a* and 21*b* of the shield parts 20*a* and 20*b* although generally planar, are provided with a multiplicity of V-shaped grooves 40*a* and 40*b* therein (see particularly FIGS. 7 and 7*a*). The grooves 40*a* and 40*b* extend substantially parallel to the longitudinal axis of the filament 15 and are provided over the whole of the areas of the upper surfaces 21*a* and 21*b* except for inner edge portions thereof where a plurality of steps 41*a* and 41*b* are provided in the surfaces 21*a* and 21*b*. The steps 41*a* and 41*b* are parallel with the grooves 40*a* and 40*b*. Upwardly directed portions or "treads" 42*a* and 42*b* are inclined relative to the location of the filament 15 such that they are in shadow so as to reduce light scatter therefrom. The whole of the surfaces 21*a* and 21*b* is provided with a dark matt or non-reflective finish. This finish serves to minimise stray reflections from the upper surfaces 21*a* and 21*b* and the V-shaped grooves 40*a* and 40*b* serve to scatter any reflective light which may be reflected in spite of the dark matt finish. The shield parts 20*a* and 20*b* are furthermore provided with respective raised formation 29*a* and 29*b* thereon to enable a front or uplight shield 30 to be securely mounted thereon. The raised formations 29*a* and 29*b* are provided on the surfaces 21*a* and 21*b* in the region of the juncture between the grooves 40*a* and 40*b* and the respective steps 41*a* and 41*b*. Each raised formation 29*a*, 29*b* has an outer side edge which is inclined relative to the other so that the outer side edges are mutually flared outwardly in the direction of the bulb holder 26. Intermediate the ends of each side edge, each raised formation 29*a* 29*b* includes an outwardly extending raised abutment 35*a* 35*b*. The uplight shield 30 has a slot 36 in each side thereof. Each slot 36 has a recess (not shown) in its upper edge. The uplight shield 30 is mounted on the shield parts 20*a* and 20*b* by forcing the shield parts 20*a* and 20*b* into the respective slots 36. The sides of the shield 30 engage against the flared outer side edges of the raised formations 29*a* 29*b* and are thereby forced apart. When the shield 30 is in the correct axial position, the raised abutments 35*a* 35*b* enter the recesses in the upper edges of the slots 36 to retain the filament against further axial movement relative to the shield parts 20*a* and 20*b*. Lateral movement of the shield 30 is prevented because of engagement of the sides thereof with the outer side edges of the raised formation 29*a* 29*b*. The flaring of the latter ensures a vibration free mounting because of the outward stressing of the otherwise mutually parallel sides of the shield 30. The uplight shield 30 serves, in the usual way, to prevent light emanating directly from the filament to pass out of the lamp assembly without being reflected from either one of the reflective portions 11 and 12. Although it is not shown in FIGS. 5–8, the manner in which the quartz halogen bulb is mounted in the bulb holder 26 will be appreciated by a person skilled in the art and, in any case, is shown in our co-pending British patent application No. 25310/76. Thus, when the halogen bulb is mounted in the bulb holder 26, the filament thereof is mounted in the manner of filament 15 as described with reference to FIG. 1 with the shield parts 20*a* and 20*b* being mounted relative to the filament in the manner described with reference to FIG. 3. Thus, in this embodiment, the filament is mounted with its axis slightly above the split line 13 which has been displaced downwardly below the axis of the reflector 10. The beam projected by the lamp assembly of FIGS. 5 to 8 without the lens element 25, is the same as that illustrated in FIG. 4. Even taking into account any beading of the lacquer in the region of the split 13.

In the above-described embodiment, the axis of the filament is 0.5 mm above the optical axis of the reflector, and the upper surfaces 21*a* and 21*b* of the shield part 20*a* and 20*b* lie in planes which intersect on the optical axis of upper reflective portion 11 of the reflector. Additionally, the bulb holder 26 and shield 20 can be rotated in the reflector 10 so as to provide the required cut-off beam pattern for use on roads where vehicles are driven on the right-hand side of the road as opposed to the beam pattern illustrated which is for use in countries where vehicles are driven on the left-hand side of the road.

The manner in which the shapes of each shield portion 20*a*, 20*b* is determined will now be described with reference to FIGS. 9 to 11 where shield part 20*a* is the one chosen to be illustrated.

As mentioned hereinabove, the inner edge 22*a* of the shield part 20*a* has to be in position as close to the filament 15 as possible having regard to the presence of the envelope 17 and to the tolerance requirements. The distance of the inner edge 22*a* from the filament 15 is illustrated in FIG. 10 as *b*. The distance from the centre-line of the filament 15 to the outer diameter 18 of the envelope 17*b* is given as B in FIG. 10. The thickness of the inner edge 22*a* is, as mentioned above, the minimum possible for an accurate die casting and is given as $h_1$. Normally, this distance will be 0.5 mm.

Now consider a point P on the aperture of the upper reflector portion 11 at a distance Z from a vertical plane passing through the centre line of the filament 15. When a line is struct from point P to point 18, and a line is taken from centre-line of the filament 15 through L (the lowermost extent of side edge 22*a*), the intersection of the two lines gives the depth of the shield part 20*a* at that section on the reflector part 11. Point P is the lowest point on the chosen vertical section of the upper portion 11 of the reflector which gives rise to reflections required to be masked.

Figure 9:
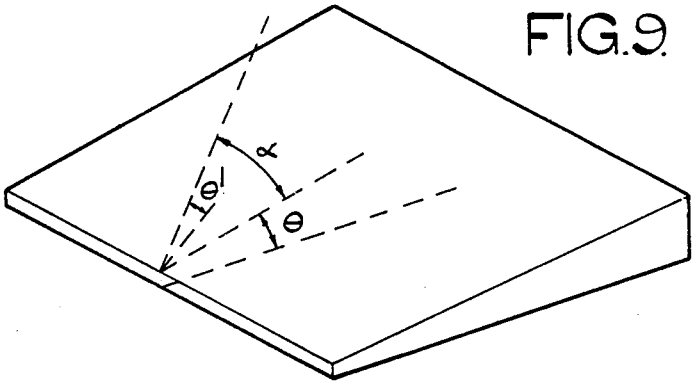

From this, it can be seen a wedge shape has been developed (FIG. 9). For other points on the reflector portion 11, sections through this wedge have been taken and the angle $\theta$ on FIG. 10 becomes a compound angle $\theta_1$ made up of $\theta$ and $\alpha$ from FIG. 11 giving $\theta_1 = \theta \cos \alpha$.

Figure 10:
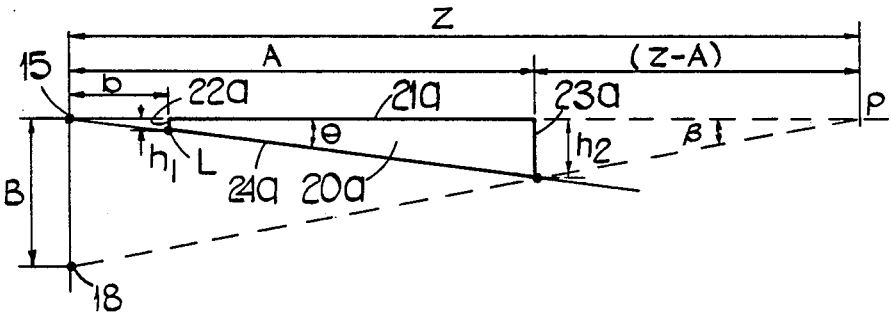
Figure 11:
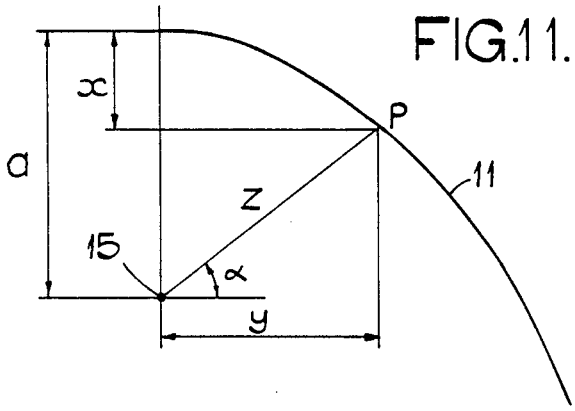

Using the above information, A in FIG. 10 can be found for various aperture distances y in FIG. 11. Thus, $$\tan \beta = \frac{B}{Z} \qquad \beta = \tan^{-1} \frac{B}{Z}$$

$$h = A \tan \theta$$

$$h = (Z - A) \tan \beta$$

$$\therefore \quad A \tan \theta = (Z - A) \tan \beta$$

$$\frac{\tan \theta}{\tan \beta} + 1 = \frac{Z}{A}$$

$$A = \frac{Z}{\frac{\tan \theta}{\tan \beta}} + 1 \quad \text{at the Latus Rectum}$$

For other points on the reflector portion 11, $$A = \frac{Z}{\frac{\tan (\theta_1 \operatorname{Cos}\alpha)}{\tan \beta}} + 1$$

From FIG. 11

$$Z = \sqrt{y^2 + (a - x)^2} \qquad y^2 = 4\,ax$$

$$x = \frac{y^2}{4a}$$

$$\therefore Z \sqrt{y^2 + \left(a - \frac{y^2}{4a}\right)^2}$$

$\therefore$ For varying values of $y$ $$A = \frac{\sqrt{y^2 + a - \frac{y^2}{4a}\Big)^2}}{\frac{\tan (\theta_1 \cos\alpha)}{\tan \beta}} + 1$$

to find $$\operatorname{Cos} \alpha = \frac{y}{z} \quad \alpha = \operatorname{Cos}^{-1} \frac{y}{z}$$

knowing A and $\alpha$ from the above formula the curve for the shield wings can be plotted.

On analysis the curve approximates to an arc of a circle so that the outer edge 23*a*, 23*b* can be arcuately curved, as shown in FIG. 8.

In the above described embodiment, a reflector has been used which has upper and lower paraboloidal portions 11 and 12 whose foci are not coincident and whose focal axes are mutually inclined. However, it is within the scope of the present invention to use the shield portions, *mutatis mutandis*, in a reflector of a type in which the portions 11 and 12 are homofocal and/or in which the focal axes are coincident. It is also within the scope of the present invention to utilise a reflector shape which is not paraboloidal and which may be elliptical or of the form described in our co-pending British patent application No. 17989/77, the disclosure of which is incorporated herein by reference.

Also in the above described embodiments, the step defining the split 13 faces downwardly internally of the reflector 10. Although this is a preferred construction, it is also within the scope of the present invention to provide a construction in which the step faces upwardly since the provision of the shield 20 will mask, at least to some extent, the upwardly facing step and so tend to prevent unwanted reflections therefrom.

The integral die casting of shield 20 and bulb holder 26 is preferably of zinc alloy to ensure satisfactory operation at the working temperature of the headlamp.

Although the above described filament shield 20 reduces the solid angle of collection of the reflector 10, the reduction is of a low order and the benefits of improved cut-off control greatly overcomes any problem that may be expected from the loss in light output. It is however, possible by selection of reflectors of different parameters to recover this light output loss by, for example, increasing the depth of the reflector and reducing the focal length.

In the place of using die cast shield parts, sheet metal shield parts may be used. In such an event, it is preferred for each part to comprise a planar sheet portion corresponding to the upper surface 21*a* or 21*b* and an integral downwardly turned sheet portion corresponding to the outer side edge 23*a* or 23*b*. The downwardly turned sheet portion serves to strength the planar sheet portion against flexing.

I claim:

1. A vehicle headlamp assembly comprising a reflector having upper and lower reflective portions separated by a split line, and a filament shield, said filament shield comprising a pair of plate portions disposed on opposite sides of a location at which a lamp filament is located in use, each plate portion being substantially aligned with the split between the upper and lower reflective portions and extending forwardly of the headlamp assembly substantially axially of the reflector, and said shield permitting light to pass from said location for reflection off both reflective portions of the reflector but preventing light passing from said location for reflection off the split line and also preventing light reflected from the envelope of a bulb mounted with its filament at said location from passing for reflection off said upper reflective portion.

2. An assembly as claimed in claim 1, wherein each filament shield plate portion is formed of thin sheet material having an outer edge portion which is turned out of the plane of the sheet to reinforce the latter against flexing.

3. An assembly as claimed in claim 1, wherein each plate portion is a die casting.

4. An assembly as claimed in claim 1 or 3, wherein an outer edge of each plate portion has a thickness which is greater than that of an inner edge of the plate portion by an amount such that there is substantially no further obscuring of the reflector from light emanating directly from the filament over and above the obscuring produced by the inner edge.

5. An assembly as claimed in claim 1, wherein at least a portion of an upper surface of each plate portion has grooves therein and has a matt or non-reflective finish.

6. An assembly as claimed in claim 1, wherein at least a portion of the upper surface of each plate portion has steps therein, the steps having upper surfaces or treads which are angled relative to the filament location such that, in use, they are in shadow.

7. An assembly as claimed in claim 1, wherein the plate portions are die cast integrally with a bulbholder which is mounted in a rear aperture in the reflector.

8. An assembly as claimed in claim 1, wherein each plate portion provides a support for an uplight filament shield.

9. A die casting comprising a bulbholder and an integral filament shield as defined in any preceding claim.

* * * * *